US005657635A

United States Patent [19]

Benoit et al.

[11] Patent Number: 5,657,635

[45] Date of Patent: Aug. 19, 1997

[54] METHOD FOR OBTAINING VERY LOW TEMPERATURES

[75] Inventors: Alain Daniel Benoit, Eybens; Serge Pujol, Poisat, both of France

[73] Assignee: Centre National d'Etudes Spatiales, Paris, France

[21] Appl. No.: 578,656

[22] PCT Filed: Jul. 4, 1994

[86] PCT No.: PCT/FR94/00818

§ 371 Date: Apr. 17, 1996

§ 102(e) Date: Apr. 17, 1996

[87] PCT Pub. No.: WO95/02158

PCT Pub. Date: Jan. 19, 1995

[30] Foreign Application Priority Data

Jul. 5, 1993 [FR] France ..... 93 08201

[51] Int. Cl.[6] ..... F25B 19/02

[52] U.S. Cl. ..... 62/51.2; 62/610

[58] Field of Search ..... 62/51.2, 610

[56] References Cited

U.S. PATENT DOCUMENTS

| | | | |
|---|---|---|---|
| 4,080,802 | 3/1978 | Annable | 62/51.2 |
| 4,126,017 | 11/1978 | Bytniewski et al. | 62/51.2 |
| 4,697,425 | 10/1987 | Jones | 62/51.2 |
| 4,991,401 | 2/1991 | Benoit | 62/51.3 |
| 5,063,747 | 11/1991 | Jones et al. | 62/51.2 |
| 5,119,637 | 6/1992 | Bard et al. | 62/51.2 |
| 5,150,579 | 9/1992 | Hingst | 62/51.2 |

FOREIGN PATENT DOCUMENTS

| | | |
|---|---|---|
| 1229528 | 10/1984 | U.S.S.R. . |
| 2166535 | 5/1986 | United Kingdom . |

OTHER PUBLICATIONS

Cryogenics, vol. 30, Sep. 1990, pp. 447–451.
Cryogenics, vol. 30, No. 1, Jan. 1990, pp. 52–55.
Cryogenics, vol. 27, No. 8, Aug. 1987, pp. 454–457.
Advances in Cryogenic Engineering, vol. 35, Part B, pp. 1079–1086.

*Primary Examiner*—Ronald C. Capossela
*Attorney, Agent, or Firm*—Jacobson, Price, Holman & Stern, PLLC

[57] ABSTRACT

Temperatures of 0.2° K or lower are achieved by feeding 3He and 4He separately into a mixing chamber (5) in an enclosure (3) in which the temperature is held at around 2° K. The endothermal dilution of 3He into 4He provides the required cold. The resulting mixture (M) passes out of the mixing chamber and the enclosure while cooling the incoming fluids by means of exchangers (1, 12, 4). To compensate for thermal losses, the mixture (M) also undergoes Joule-Thompson expansion (12) optionally followed by evaporation (13), preferably between about 1.5° and 2.5° K, and the resulting cold is used to lower the temperature of the incoming fluids from well above 4° K to between 1.5° and 2.5° K, which is close to the temperature prevailing inside the enclosure (13) containing the coldest point (6) in the circuit.

4 Claims, 2 Drawing Sheets

METHOD FOR OBTAINING VERY LOW TEMPERATURES

The present invention relates to a method and a device for obtaining very low temperatures, less than approximately 1 K and, in particular, than 0.1 K.

Document EP-A-0,327,457, which corresponds to U.S. Pat. No. 4,991,401 and which cites as inventor one of the authors of the present invention, describes a cryostat which comprises a mixing point in which there is maintained a two-phase system comprising a solution phase of 3He in liquid 4He and a liquid phase formed by pure 3He. Liquid 3He and 4He are separately introduced continuously into a mixing point and the solution is extracted from the mixing point at such a rate that the 3He cannot flow back to increase the 3He content of the 4He and consequently render the latter less capable of dissolving the liquid 3He introduced. The mixing point is placed in an enclosure cooled at least to 2 K.

More precisely, in the mixing point, the two fluids create, by being mixed, a two-phase system comprising a phase rich in 3He and a dilute phase, the energy of dilution or of solution being used for the cooling, the progression of the two phases in the mixture outlet tube preventing the dissolved 3He from diffusing in countercurrent into the cold part of the system, whereas, at a higher temperature (above 0.5 K), the solubility of 3He in 4He increases, the mixture then includes only a single phase and the rate must be sufficient for the 3He not to be able to diffuse in countercurrent.

This cryostat has the advantage that it can operate in the absence of gravity because it does not comprise a distiller, which makes it particularly advantageous for use in space. When used in this context, the cryostat can operate by discharging into space the small quantities of 4He and 3He mixture which it produces. In the case when the vehicle is to return to earth, this mixture may also be stored in a reservoir, with a view to distilling it on the ground. If the cryostat is used on the earth, it can of course be coupled with a distillation apparatus, with the assembly then operating in a closed circuit.

One difficulty encountered in the use of this cryostat results from the necessity of having a superfluid helium reservoir for keeping the enclosure at less than 2 K, which constitutes a complication. It is known that such storage imposes particular constraints which are difficult to fulfil, in particular on board a spacecraft.

The object of the present invention is to provide a cryostat which operates according to the method described in EP-A-0,327,457 and which has a simple structure, is compact and consumes little energy, and more especially is free of the necessity of producing and/or storing superfluid helium for cooling the enclosure to 2 K or less.

In order to obtain this result, the invention provides a method for obtaining very low temperatures, according to which 4He and 3He, which are cooled with the aid of heat exchangers to a temperature of the order of 0.2 K or below, are continuously introduced into the point where they are mixed to absorb heat by dilution of the 3He in the 4He, thus producing cooling of the closed two-phase mixture, which mixture is extracted through a conduit designed so that the 3He cannot diffuse in countercurrent and reduce the dissolution of 3He, in which method a heat exchanger adjacent the mixing point is used to cool, by the extracted mixture circulating in the opposite direction, the fluids flowing toward the coldest point, the main feature of this method being that the 4He and the 3He which are intended to be mixed are cooled from their supply temperature to a temperature of less than 2.5 K by exchange with the extracted mixture, the power being absorbed by using a Joule-Thomson expansion of this mixture, thus permitting the system to operate with a supply temperature well in excess of 4 K.

The cooling power during the Joule-Thomson expansion depends only on the input and output pressures of the mixture. The best performance is obtained with pressures of the order of 2 to 15 bar on input and 1 to 15 millibar on output.

The invention results from the observation that, by expedient use of the Joule-Thomson expansion of the fluids used for the method for cooling to very low temperatures, it is possible to precool the fluids entering the system from a much higher temperature, of the order of 4 to 10 K, making it possible to do without the auxiliary precooling equipment necessary in the prior art, and in particular the superfluid helium bath. Temperatures of 4 to 10 K are easy to obtain with a Stirling cryogenic machine followed by a conventional liquid 4He Joule-Thomson stage.

The invention will now be explained in more detail with the aid of practical examples, illustrated with the aid of the figures in which:

FIG. 1 shows the schematic diagram of a practical embodiment which operates according to the indications of the abovementioned document EP-A-0,327,457.

Figure 1:
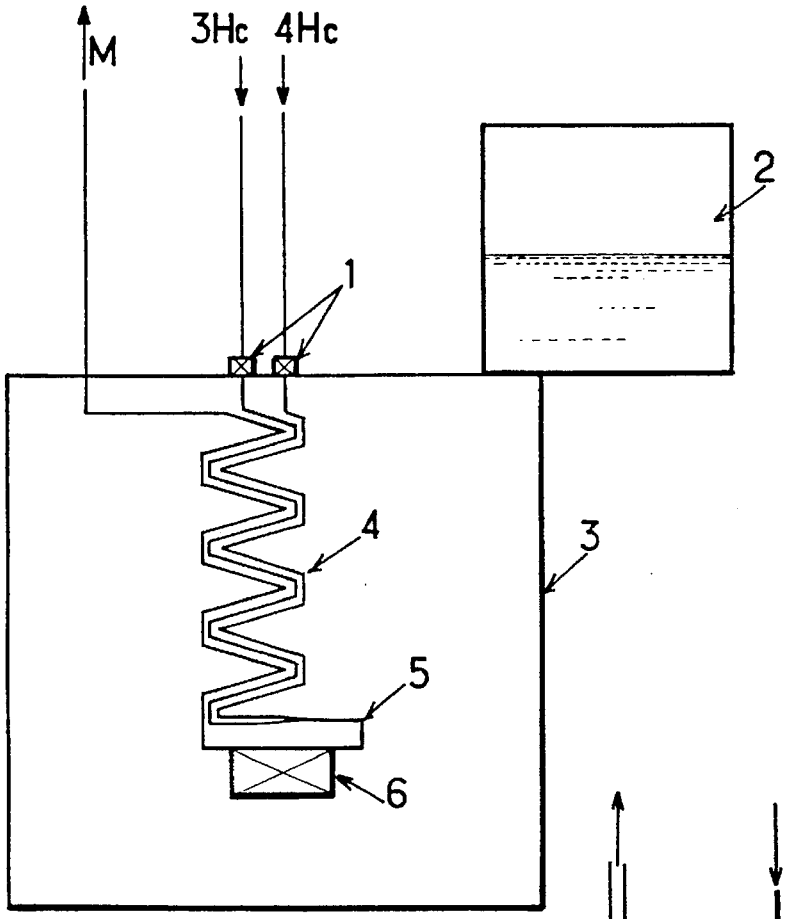
FIG. 1 is a theoretical diagram of the equipment of the prior art.

Pure 4He gas and 3He gas are each injected, under pressure (approximately 3 bar) and at ambient temperature, into a heat exchanger 1 in contact with a superfluid helium reserve, symbolically represented at 2, also connected with the enclosure 3 of the cryostat, and are cooled to approximately 2 K. The two fluids are then cooled in a temperature exchanger 4, then the heat absorbed by mixing them in a mixing chamber 5 makes it possible to cool a support 6 to a temperature of the order of 0.1 K. The mixture M absorbs heat in the exchanger 4 before exiting the cryostat at an output pressure kept in the region of 2 bar. The difference between this pressure and the input pressure is due to the pressure drop in the exchangers.

In the practical embodiment, the exchanger 4 comprises two parts: the hot part (0.5 K to 2 K) with a length of 1 meter is composed of three tubes, of internal diameter 0.03 mm, welded together, whereas the cold part (0.1 K to 0.5 K) is formed by three tubes, with diameter 0.02 mm and length 3 m, welded together.

Figure 2:
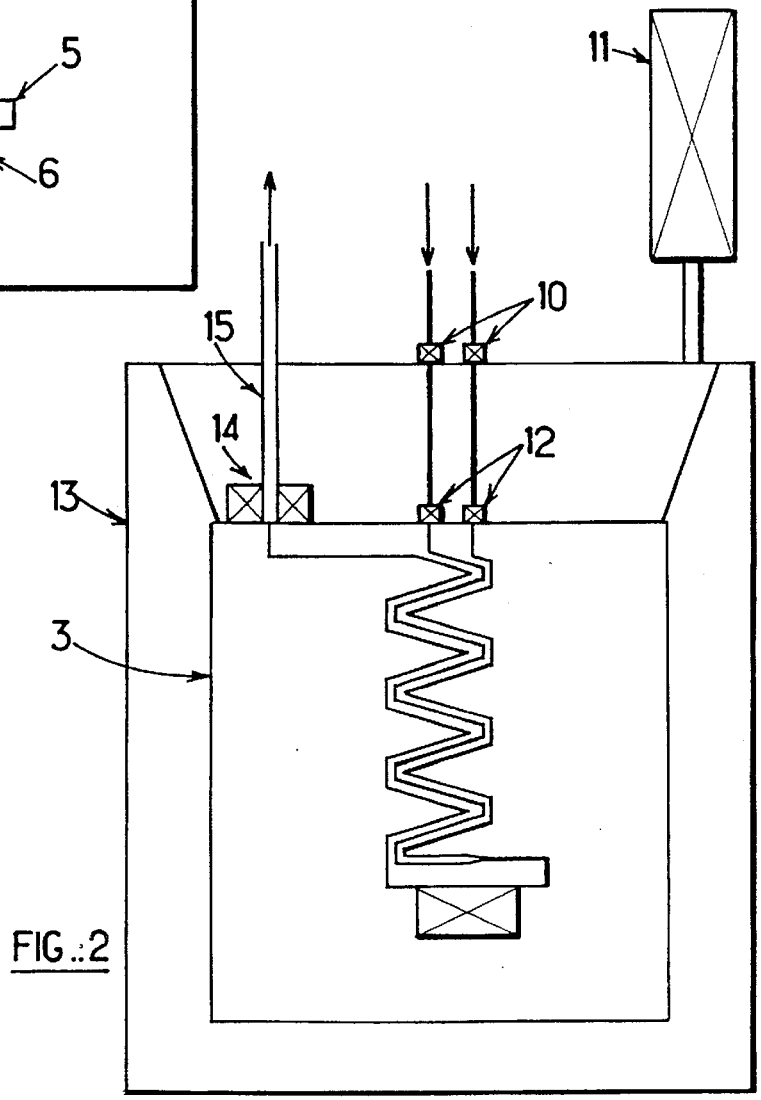
FIG. 2 is a theoretical diagram of the equipment according to the invention.

FIG. 2 is a schematic view of the device of FIG. 1 modified according to the invention. On both figures, the same references denote the same elements.

Pure 4He and 3He gases are injected under pressure (between 2 and 20 bar) and at ambient temperature. They are then cooled to between 4 K and 10 K by exchangers 10, themselves coupled to an auxiliary precooling machine 11. Entering an outer enclosure 13, the fluids are cooled to a temperature of the order of 2 K by the exchangers 12, themselves coupled to an intermediate enclosure 3. The interior of this enclosure is identical with that of FIG. 1.

At the outlet of the exchanger 4, the mixture has undergone a pressure drop and is at low pressure in an exchanger 14 where the liquid is evaporated, delivering a high refrigerating power which is used to cool the screen bounding the outer enclosure 13, as well as the fluids entering through the exchangers 12. The mixture 11 then exits the cryostat at low pressure (between 1 and 50 millibar) through a tube 15.

Figure 3:
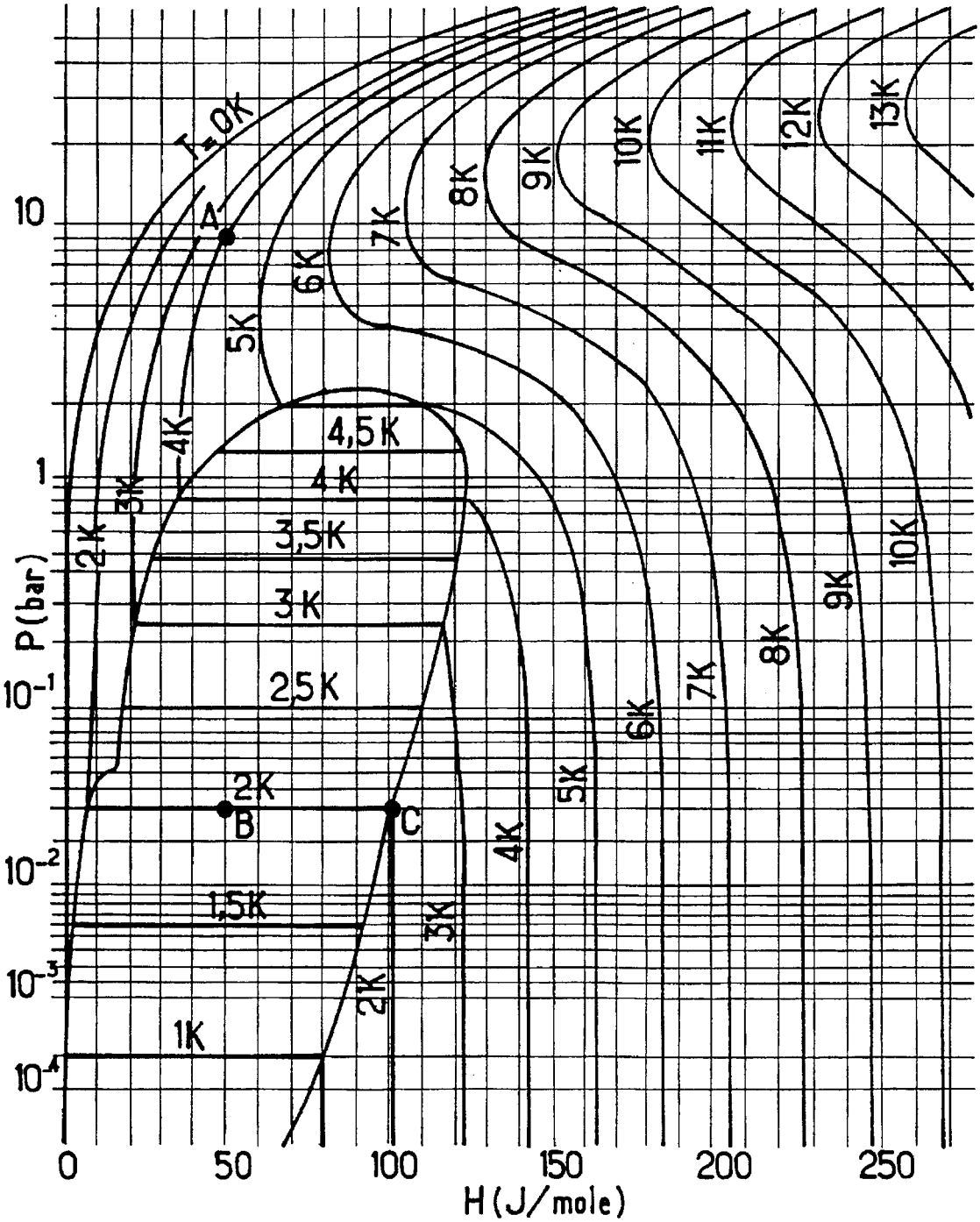
FIG. 3 is an enthalpy diagram for helium-4, on which the important points in the diagram of FIG. 2 are marked.

FIG. 3, which represents an enthalpy diagram for helium-4, makes it possible to understand the physical aspect of the phenomena taking place inside the apparatus. This diagram relates to pure helium-4, whereas helium-4 and helium-3 are used, either separately or in a mixture. In practice, the proportion of helium-3 to helium-4 is relatively small, approximately 20%, so that the diagram of FIG. 3 nevertheless gives a fairly good overall idea of what takes place.

With an input pressure of 9 bar and a temperature of 4 K, for example (point A), the enthalpy is 50 J/mole. If the output pressure is fixed at 30 millibar, the fluid retains its enthalpy and comes to point B at a temperature of 2 K, with a partly vapor and partly liquid two-phase mixture. The available cooling power is given by the enthalpy difference between the points B and C, i.e. approximately 50 J/mole. With a typical flow rate of 10 μmole/s, the available power at the enclosure 3 is therefore 0.5 mW. With an input temperature of more than 7 K, the same reasoning leads to zero available power. It is then necessary to add a continuous heat exchanger between the inlet tubes connecting the exchangers 10 and 12 and the outlet tube 15. Using such an exchanger coupled to a Joule-Thomson expansion is a well-known method which makes it possible to operate such an expansion with a higher starting temperature (up to 10 K or 20 K).

With the flow rates used (1.5 μmole/s of 3He and 6 μmole/s of 4He), the gas quantities necessary are 1000 liters per year of helium-3 and 4000 liters per year of helium-4. If standard high-pressure bottles are used (volume 5 liters, pressure 200 bar, mass 6.7 kg), the cryostat needs only one bottle of helium-3 and four bottles of helium-4 per year, which corresponds to 33.5 kg per year. These masses can be reduced easily by using high-pressure bottles made of stronger materials.

Since all the fluids are confined in small tubes and there is no free surface area for base separation, the system is insensitive to gravity.

The simplicity of the system allows very simple control by adjusting the flow rates of the two fluids at the inlet of the cryostat. This makes it possible to stop and restart the dilution in order to optimize the gaseous helium consumption.

With this structure, it is possible to cool detectors, for example to a temperature of 0.1 K, in a satellite, using a small cryogenic source absorbing a power of a few milliwatts at a temperature of 5 K. The method is very reliable since it includes no mechanical parts and requires of the order of 5000 liters of gas per year in order to be used. The device is therefore well-suited for long-term experiments, in particular in space.

We claim:

1. A method for obtaining very low temperatures, comprising the steps of:

a) cooling 4He and 3He from their supply temperature to a temperature of less than 2.5 K, b) further cooling 4He and 3He to a temperature of the order of 0.2 K or below, with the aid of heat exchangers, c) introducing 4He and 3He into a point (5) where they are mixed to absorb heat by dilution of the 3He in the 4He, thus producing cooling of the produced two-phase mixture, d) extracting mixture (M) through a conduit designed so that the 3He cannot diffuse in countercurrent and reduce the dissolution of 3He, e) feeding a heat exchanger (4) adjacent the mixing point (5) with the extracted mixture (M) to cool the fluids flowing toward the coldest point, and wherein, in step (a), the 4He and the 3He are cooled by exchange with the extracted mixture, the power being absorbed by a Joule-Thomson expansion of said mixture, thus permitting the system to operate with a supply temperature well in excess of 4 K.

2. The method as claimed in claim 1, wherein the Joule-Thomson expansion results in a pressure drop to approximately 1 to 50 mb, the supply pressure of 4He and of 3He being approximately 2 to 15 bar.

3. The method as claimed in claim 1, wherein the expansion and a possible subsequent vaporization of the mixture are carried out between approximately 1.5 and 2.5 K.

4. The method as claimed in claim 1, wherein the mixing point (5) and the adjacent exchanger (4) are placed in an enclosure (13) kept at a temperature of less than 2.5 K.

* * * * *